United States Patent [19]

Chouteau et al.

[11] 4,201,229

[45] May 6, 1980

[54] PROCESS FOR TREATING A FLOW OF TOBACCO LEAVES

[75] Inventors: Jacques Chouteau, Bergerac; Pierre Magne, Saumur, both of France

[73] Assignee: Service d'Exploitation Industrielle des Tabacs et des Allumettes, France

[21] Appl. No.: 818,216

[22] Filed: Jul. 22, 1977

[30] Foreign Application Priority Data

Jul. 22, 1976 [FR] France ..... 76 22316

[51] Int. Cl.[2] ..... A24B 3/00; A24B 5/00; A24B 5/14

[52] U.S. Cl. ..... 131/146; 131/147 R; 131/149

[58] Field of Search ..... 131/140 P, 146, 147, 131/149, 140 R, 123, 122, 128

[56] References Cited

U.S. PATENT DOCUMENTS

| | | | |
|---|---|---|---|
| 3,401,701 | 9/1968 | Pietrucci | 131/146 |
| 3,409,025 | 11/1968 | Wochnowski | 131/146 |
| 3,409,027 | 11/1968 | de la Burde | 131/147 R |
| 3,410,280 | 11/1968 | Wochnowski | 131/146 |

*Primary Examiner*—V. Millin

*Attorney, Agent, or Firm*—Jacobs & Jacobs

[57] ABSTRACT

Process for treating a flow of tobacco leaves, characterized in that it comprises removing the parenchyma from the ligneous parts at a time when at least said ligneous parts of the leaves have a relative humidity of at least 70%, separating the leaf fragments thereby obtained into two homogeneous flows composed respectively of the parenchyma and the ligneous parts and treating separately the parenchyma and the ligneous parts.

6 Claims, No Drawings

PROCESS FOR TREATING A FLOW OF TOBACCO LEAVES

The present invention relates to a process for treating a flow of tobacco leaves.

In the most usual manner, the tobacco is subjected, after the crop, to treatments which may vary according to the types (brown or blond) and varieties; after a drying operation comprising a yellowing and eventually a browning operation, the tobacco leaves are subjected to a more or less lengthy fermentation before being stripped or threshed.

This procedure has many disadvantages. Particularly, it subjects the two parts of the leaf to identical treatments, i.e. The parenchyma (or leaf material) and the ligneous parts (or ribs): but these two leaf elements are on the one hand of different constitutions and therefore do not react in the same way to identical treatment conditions; and on the other hand their quality and further use are not the same. It may therefore turn out to be advantageous, even necessary, to subject each of them to specific treatments which are most appropriate.

According to a principle known since long, the two leaf elements, i.e. parenchyma and ribs, have a different behaviour when they are subjected to the same treatment.

But above all, the treatments to which is generally subjected tobacco after the crop have the following primary disadvantages: before being stripped or threshed, the tobaccos are subjected to a series of transformations, notably physical and chemical. Substantially, an important part of the water content of the plant has taken place; the result being that the parenchyma is faded and that the ribs, which have lost in rigidity and volume, are now flexible and pliable. When the parenchyma and ribs have to be separated, either by stripping or by threshing, the ribs are therefore no more in a position to serve as framework for the leaves in order to preserve at least partially their original shape. Under the smallest impact, the ribs bend, fold over and get mixed into each other. This behaviour of the tobacco leaves causes important disturbances in the threshing members and decreases their efficiency. The parenchyma is stripped at a lesser speed and with a reduced efficiency than the ribs; the ribs remain sometimes entire, preserving attached to them parenchyma in a quantity which is increased proportionnally if they have been folded over and mixed to each other, and they may more or less obstruct the discharge openings of the threshing apparatus, as well as perturb the process in the area where the streams are separated at the discharge end of the threshing apparatus. It is also obvious that when the ribs are being stripped, the leaves have to be presented spred and lying in layers. The preparation of the leaves is actually performed by the stripping operative and requires some time.

A further object of the invention is to remedy the hereinabove described disadvantages. It is characterized in that the parenchyma is removed from the ligneous parts at a time when at least said ligneous parts of the leaves have a relative humidity of at least 70% and the leaf fragments thereby obtained are separated into two homogeneous flows composed respectively of the parenchyma and the ligneous parts, then in that the parenchyma and the ligneous parts are separately treated.

This process has many advantages:

it provides the possibility, as soon as the harvest is finished, to deversify and adapt the treatments to each of the two leaf elements: the parenchyma being the noble part of the leaf will be subjected to "gentle" treatments favouring its evolution (for instance via a progressive dehydration); whereas the ribs will be, in particular, brutally dehydrated after having been previously subjected to eventual treatments for facilitating the operation (crushing, etc.);

it provides also the possibility to subject the parenchyma and the ribs to similar but separate treatments, so that in particular drying parameters (such as temperature, duration, ventilation . . .) may be applied which correspond to their respective attitude to dehydration. It is in fact easier to dry the parenchyma than the ribs. For instance, in the case where the plant is dried in the open air, the parenchyma is generally dry in less than 3 weeks, whereas 45 days are needed for the ribs;

the separation of the leaf fragments into two homogeneous streams consisting respectively in the parenchyma and the ribs is also substantially improved: such a phenomenon is easily explained by the difference of the weight/bearing surface ratio;

a further essential advantage of the process according to the invention lies in that the separation of the parenchyma and the ribs through threshing or stripping, is better performed and under better conditions that when the tobacco leaves had been previously subjected to drying as such.

The separation is actually carried out when the leaf ribs have a water content close to that which they had when they were harvested, that is at least 70% (relative humidity). They are then gorged with water and display some rigidity; this allows them to act as framework for the leaves and to maintain them in their initial shape, at least in the longitudinal direction. Such a presentation for the leaves is advantageous fro stripping as well as for threshing.

As regards stripping, the handling and cutting of the leaves are largely facilitated: the leaves are seized and spread more easily due to the firmness provided by the ribs; positionning of the leaves on the cutting table is also made easier because of the important volume of the ribs relative to the thickness of the parenchyma; the cutting of the leaf material on either side of the ribs is also cleaner due to the fact that in this area, the rib maintains the parenchyma under tension and prevents it from folding, even if the latter is already slightly faded.

As regards more particularly the separation by threshing, the process according to the invention provides substantial advantages: due to the rigidity of the rib, the leaf is maintained extended at least in the longitudinal direction, the parenchyma is therefor maintained more or less spread out and offers a larger surface to the teeth of the threshing apparatus. Moreover, the rigidity of the ribs on the one hand prevents them from being mixed to each other; on the other hand, and associated with the fact the ribs are breakable, this rigidity permits that they be quickly broken in several fragments by the teeth of the threshing member; and that they may therefore be quickly removed without stagnating in the area of the discharge openings.

But for such a result, it is not indispensable that the parenchyma has itself also a relative humidity close to that of the harvest. The process according to the invention may be carried out according to two modes of application, each of which has many advantages: according to one of these modes, the ribs alone have necessarily a relative humidity close to that of the harvest; according to the other mode, the two parts of the leaf, the parenchyma and ribs, have a relative humidity close to that of the harvest. The choice between either of said modes will be made in relation with the general organization of the operation, according to the transportation facilities, the machinery and labour which area available downstream of the process, etc.

It is possible that entire leaves have previously started to dry through a natural or artificial process. Generally, the ribs remain gorged with water (relative humidity of the order of 80%) and keep their characteristics with only slight modifications. On the other hand, the parenchyma dries up relatively quickly. This results in an increased difference between the relative humidity and therefore the densities between both parts of the leaf. After for instance 15 days of preservation at room temperature, the respective relative humidities of the parenchyma and the ribs are of the order of 30% and 80%. The advantage of a previous partial drying of the leaves is therefore obvious as regards the separation of the materials, that is of the parenchyma fragments and the rib fragments.

It may happen that a previous partial drying of the leaves makes the ribs more flexible (relative humidity of the order of 70%) than are turgescent ribs. Being then less brittle, they come out from the threshing member less broken up: hence the risk when using a horizontal threshing machine that the large rib fragments form with the parenchyma fragments a compact maze in the discharge area which would make a good separation difficult is not impossible. It is therefore preferable to utilize, within the scope of the present invention, a vertical thresher: as the separation follows immediately the discharge of the fragments out of the threshing member as such, the risk of jamming is avoided.

According to another mode of application, the process according to the invention is characterized in that the parenchyma is removed from the ligneous parts when the entire leaves, in all their parts, still have a relative humidity close to that of the harvest. And preferably, the parenchyma is removed from the ligneous parts when the leaves are still brittle or breakable.

Such a procedure may surprise in the first approach: due to the high moisture content present in the leaves, one might have feared to obtain, after threshing, a "green pulp".

On the contrary, the results thus obtained are very satisfactory: a very high proportion of parenchyma without ribs is obtained in the very first run in the threshing member (about 88%). morerover, the granulometry is good, meaning that the dimensions of the parenchyma fragments are satisfactory. It is essential actually to obtain after the threshing operation parenchyma fragments which are not of two small dimensions; the fragments which are too small are degraded like the other by the subsequent treatments, but due to their small dimensions, they usually turn out into waste and powder.

The phenomenon may be explained in the following manner: when the plant leaves are brittle, breakable, the parenchyma is easily removed from the rib and gives fragments of respectable dimensions whereas the ribs are cleaned in a satisfactory manner.

It is a well known fact that this state disappears quickly (more or less according to the atmospheric conditions, the moment of day when the crop is made, . . .). The process according to the invention is therefore also characterized in that the threshing is carried out immediately after the harvest. It is even possible to consider carrying the operation on the spot. It is also possible to preserve the tobacco leaves in such manner that they are maintained brittle during a prolonged period. This second possibility may be achieved by storing the leaves in sheltered premises, in perforated containers, preferably in a vertical position. Under such conditions, the leaves may be maintained brittle for several days.

Once the threshing is over, the stream coming out from the threshing apparatus is separated into two homogeneous streams consisting respectively in the parenchyma and the ribs.

According to a characteristic of the invention, there is provided between the two threshing and separating operations a dehydration operation at least partial of the parenchyma/ribs mixture. Since the parenchyma dehydrates much more easily than the ribs, the density difference between the two components of the mixture increases and the separation is facilitated. Of course, this phase of the treatment will become unnecessary, partially if not in totality, in the case where the leaves have been already partially dried before threshing.

The two tobacco leaf elements are then in such a condition that they may be treated separately.

According to a last characteristic of the invention, it is also provided to subject the ribs alone, still fresh, to a treatment for facilating the subsequent treatments to which they will be subjected, notably the dehydration. The process is characterized in that, once the separation of the streams has been carried out at the discharge opening of the threshing apparatus, a continuous compression is applied onto the ribs, transversely to their axis, and in such manner that the ribs are split longitudinally to their axis. For performing the process, the ribs are driven between two smooth cylinders. Due to their recent crop, the ribs react in some degree as green wood and split longitudinally to their axis.

According to a preferred embodiment, it is provided to apply also, in a complementary way, on the ribs and transversely to their axis, a discontinuous compression, superior to the compression applied continuously, and in such manner that the ribs split transversely to their axis.

For achieving the last characteristic of the invention, there is provided to run the ribs between two cylinders, one of which at least is formed with edges arranged along its generating line. The cylinder edges apply on the ribs, transversely to their axis, a succession of discontinuous compressions in such manner that each compression causes a transverse crack on the rib.

Being in the same time split longitudinally and cracked transversely to their axis, the ribs are burst and their core is bared, which facilitates their subsequent treatment. The process provides the possibility in particular to reduce by half at least the time of the subsequent dehydration of the ribs.

What we claim is:

1. Process for treating a flow of tobacco leaves wherein the parenchyma is removed from the ligneous parts at a time when at least said ligneous parts of the leaves have a relative humidity of at least 70%, separating the leaf fragments thereby obtained into two homogeneous flows composed respectively of the parenchyma and the ligneous parts and treating separately the parenchyma and the ligneous parts.

2. Process according to claim 1 wherein the parenchyma is removed from the ligneous parts at a moment when at least said ligneous parts of the leaf have a relative humidity close to that which they have when they are harvested.

3. Process according to claim 2 wherein the parenchyma is removed from the ligneous parts at a moment when both parts of the leaves have a relative humidity close to that which they have when they are harvested.

4. Process according to claim 1 wherein the leaf fragments thereby obtained are dried at least partially before being separated into homogeneous flows of parenchyma and ligneous parts respectively.

5. Process according to claim 1 wherein after separation of the leaves fragments into two flows of parenchyma and ligneous parts, respectively, a continuous compression is applied onto the ribs, transversely to their axis, and operable to split said ribs longitudinally to their axis.

6. Process according to claim 5 wherein a discontinuous compression is also applied on the ribs, transversely to their axis, said discontinuous compression being greater than said continuous compression and operable to split said ribs transversely to their axis.

* * * * *